US006360713B1

(12) United States Patent
Kolmanovsky et al.

(10) Patent No.: US 6,360,713 B1
(45) Date of Patent: Mar. 26, 2002

(54) MODE TRANSITION CONTROL SCHEME FOR INTERNAL COMBUSTION ENGINES USING UNEQUAL FUELING

(75) Inventors: Ilya V Kolmanovsky, Ypsilanti; Jeffrey Arthur Cook, Dearborn; Jing Sun, Bloomfield Township, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/730,181

(22) Filed: Dec. 5, 2000

(51) Int. Cl.[7] ..... F02B 17/00
(52) U.S. Cl. ..... 123/295; 123/443
(58) Field of Search ..... 123/295, 300, 123/406.23, 406.24, 704, 198 F, 430, 479, 480, 481, 436, 443, 48 R, 78 R; 701/102, 103, 110; 477/109; 180/197

(56) References Cited

U.S. PATENT DOCUMENTS 5,374,224 A 12/1994 Huffmaster et al.
5,437,253 A 8/1995 Huffmaster et al.
5,481,461 A 1/1996 Miyamoto et al.
5,496,228 A * 3/1996 Takata et al. ..... 477/107
5,549,093 A * 8/1996 Imamura ..... 123/481
5,875,761 A * 3/1999 Fujieda et al. ..... 123/399
6,000,378 A * 12/1999 Minowa et al. ..... 123/436
6,006,717 A * 12/1999 Suzuki et al. ..... 123/295
6,079,204 A * 6/2000 Sun et al. ..... 60/274
6,119,452 A * 9/2000 Kinugasa et al. ..... 60/285
6,178,945 B1 * 1/2001 Suzuki et al. ..... 123/295
6,209,526 B1 * 4/2001 Sun et al. ..... 123/481
6,237,330 B1 * 5/2001 Takahashi et al. ..... 60/285

* cited by examiner

*Primary Examiner*—Willis R. Wolfe
*Assistant Examiner*—Hai Huynh
(74) *Attorney, Agent, or Firm*—Allan J. Lippa

(57) ABSTRACT

A control method and system are disclosed for managing torque during a transition in an internal combustion engine. Spark timing and unequal delivery of fuel to engine cylinders both impact torque and are used to provide smooth torque during a transition.

20 Claims, 4 Drawing Sheets

MODE TRANSITION CONTROL SCHEME FOR INTERNAL COMBUSTION ENGINES USING UNEQUAL FUELING

FIELD OF THE INVENTION

The present invention relates to controlling torque in an internal combustion engine to provide a smooth torque transition in response to cylinder deactivation and reactivation, transmission shifts, and increase and decrease in compression ratio or to provide a desired torque transition in response to a traction control event or driver demand.

BACKGROUND OF THE INVENTION

A variable displacement engine (VDE) is one in which a portion of the cylinders of a multi-cylinder engine may be deactivated, typically for improving engine efficiency under some operating conditions. The highest thermal efficiency of an engine occurs at an engine torque that is approximately 75% of peak engine torque. Driver demand for torque, however, is often well below the peak efficiency torque level. The VDE improves efficiency by operating fewer than all cylinders closer to the peak efficiency point.

One of the problems encountered in developing a vehicle with a VDE for production is making the transitions from the situation with all cylinders active to partial cylinder activation and the reverse. For example, if four cylinders of an eight-cylinder engine were active and the operator of the vehicle demanded more torque than the four cylinders could provide, the deactivated four cylinders may be activated. The airflow to the engine nearly doubles immediately upon cylinder reactivation as now eight cylinders, instead of four cylinders, are drawing air from an intake manifold, which is at high pressure, and a torque disturbance ensues.

To rapidly change torque to allow a smooth transition for VDEs, the throttle may be closed rapidly to restrict the airflow at the same time that the cylinders are reactivated. The effect of closing the throttle occurs over a number of engine events, i.e., not instantaneously. The inventors herein have recognized than an instantaneous change is necessary to smooth the torque fluctuation during a VDE transition or other types of transitions in internal combustion engines, which are accompanied with a torque fluctuation.

In U.S. Pat. Nos. 5,437,253 and 5,374,224, assigned to the assignee of the present invention, and U.S. Pat. No. 5,481,461 spark retard is used to accomplish a smooth transition, where a transition may be a deactivation or reactivation of cylinders. As spark timing is retarded from MBT (minimum spark advance for best torque), torque is reduced. Control of spark timing is a desirable tool to use for immediately affecting torque as a change can be made effective in the next engine combustion event. Using spark timing alone, however, may not provide enough torque diminution to provide a smooth torque trajectory during the transition. Furthermore, depending on the range in spark advance allowed by the engine controller, there may be operating conditions at which sufficient spark retard is not accessible. The inventors herein have recognized that an alternative or additional measure to reduce torque in the event of a transition is needed.

EP0937880 discloses a method by which air-fuel ratio is varied to control torque to the desired level during a transition. The inventors of the present invention have recognized that air-fuel ratio excursions away from a stoichiometric proportion, occurring within an aftertreatement device, is an unsuitable approach in an engine equipped with a three-way catalyst in which the catalyst function depends on the air-fuel ratio being maintained at stoichiometry.

In U.S. Pat. No. 4,006,722, air-fuel ratio is varied among cylinders for the purpose of reducing NOx produced by the engine. All the cylinders are supplied with a rich air-fuel ratio mixture. A subset of the cylinders is supplied with supplemental air such that the subset is at a lean air-fuel ratio. The inventors of the present invention have recognized that with electronic port fuel injection, lean and rich air-fuel ratios can be supplied to cylinders without the need for additional hardware to provide supplemental air to the cylinders. The inventors have further recognized that electronic port fuel injection allows supplying a rich or lean mixture to as few as one cylinder; whereas, in U.S. Pat. No. 4,006,722, which relies on a central carburetor, a rich mixture is supplied to all cylinders.

In U.S. Pat. No. 4,006,722, additional fuel is supplied to all of the cylinders and additional air is supplied to a subset of cylinders. Both measures lead to a torque increase. The inventors of the present invention have determined an alternate method for supplying a rich mixture to some cylinders and a lean mixture to other cylinders which causes a torque decrease.

SUMMARY OF THE INVENTION

A mode transition method is provided for controlling torque produced by an internal combustion engine. The engine has a plurality of cylinders, an exhaust system containing one or more emission aftertreatment devices, and an engine controller operably connected to the engine for controlling the relative air-fuel ratio supplied to the cylinders. The method includes the steps of operating at least one cylinder at a lean relative air-fuel ratio; and operating at least one other cylinder at a rich relative air-fuel ratio to reduce emissions which would otherwise be caused by operating at least one cylinder at a lean relative air-fuel ratio. The cylinder at a lean relative air-fuel ratio and the cylinder at a rich relative air-fuel ratio provide a desired relative air-fuel ratio to the aftertreatment device, which may be a stroichiometric air-fuel ratio. A desired torque during the mode transition may be computed. The rich relative air-fuel ratio in the rich cylinders, the lean relative air-fuel ratio in the lean cylinders, and a retarded spark timing provide the desired torque.

A system for controlling torque during a transition of operating mode in an internal combustion engine is disclosed. The engine has a plurality of cylinders, an engine exhaust system containing one or more emission aftertreatment devices, a throttle valve disposed in an air intake duct, and an engine controller coupled to the engine for controlling the relative air-fuel ratio supplied to the cylinders. The engine controller provides to at least one cylinder a lean relative air-fuel ratio and to at least one other cylinder a rich relative air-fuel ratio to reduce emissions which would otherwise be caused by operating a cylinder at a lean relative air-fuel ratio. The engine controller also computes a desired throttle valve position based on a desired torque during the transition in operating mode.

Prior art methods for reducing engine torque include providing a lean relative air-fuel ratio to some engine cylinders. The present invention overcomes problems of prior art methods by providing a lean relative air-fuel ratio to some cylinders and a rich relative air-fuel ratio to some other cylinders. Prior art methods lead to a lean relative air-fuel ratio being delivered to the exhaust aftertreatment devices, which causes the aftertreatment device efficiency to degrade markedly if it is a three-way catalyst. The advantage of the present invention is that a desired relative air-fuel ratio is delivered to the exhaust aftertreatment devices, which may be a stoichiometric relative air-fuel ratio.

By using unequal fueling to cylinders, the present invention improves on the prior art method of retarding spark timing. The advantage is that unequal fueling may be combined with spark timing to provide a greater range of authority in controlling torque than retardation of spark timing alone.

Other advantages, as well as objects and features of the present invention, will become apparent to the reader of this specification.

BRIEF DESCRIPTION OF THE DRAWINGS

The advantages described herein will be more fully understood by reading an example of an embodiment in which the invention is used to advantage, referred to herein as the Detailed Description, with reference to the drawings wherein.

DETAILED DESCRIPTION OF PREFERRED EMBODIMENTS

Figure 1:
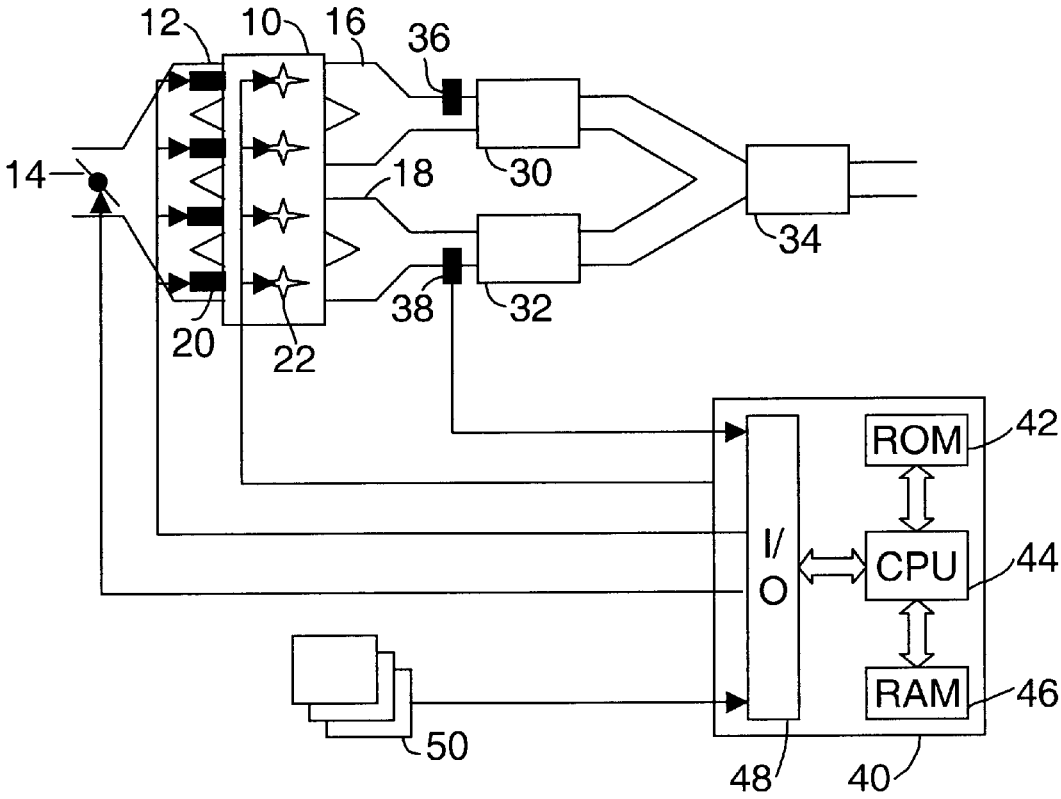
FIG. 1 is a schematic diagram of an engine showing the fuel injectors, ignition coils, electronic throttle, and exhaust gas oxygen sensors communicating with the engine control computer.

In FIG. 1 an internal combustion engine 10 is shown. Engine 10 may be a variable displacement engine (VDE). However, the invention claimed herein is applicable to any internal combustion engine.

In FIG. 1, the engine 10 also could be a variable compression ratio (VCR) engine. The mechanism by which the compression ratio is adjusted could be a variable length connecting rod, a two-piece piston which allows an expanded length or other designs known to those skilled in the art, none of which are shown in FIG. 1. A transition from low to high compression ratio in a VCR engine yields an increase in torque due to the higher efficiency operating at a higher compression ratio.

Valve deactivators or mechanisms by which a subset of the cylinders can be deactivated to facilitate variable displacement operation are not shown. A 4-cylinder engine 10 is supplied with air through an intake manifold 12 with a throttle valve 14 for controlling the amount of airflow into the engine. In FIG. 1, the injectors 20 are shown supplying fuel into the intake to the engine 10. The invention may apply to direct fuel injection in which the fuel is supplied directly to the cylinders or to port injection, or any other form of fuel induction. The spark plugs 22 are mounted in the engine cylinders. The 4-cylinder engine 10 has two cylinders supplying exhaust to exhaust manifold 16 which couples to aftertreatment device 30, with exhaust gas composition sensor 36. The corresponding equipment for the other two cylinders is: exhaust manifold 18, aftertreatement device 32, and exhaust gas composition sensor 38. For the engine 10 shown in FIG. 1, the exhaust lines exiting exhaust aftertreatment devices 30 and 32 are coupled together and the combined exhaust is provided to an aftertreatment device 34. In an alternate configuration (not shown), the two exhaust lines could be maintained separately and each exhaust line might contain an additional aftertreatment device similar to device 34 shown in the configuration of FIG. 1.

Continuing with FIG. 1, the amount of fuel injected by each fuel injector 20, the command to spark plugs 22 for each cylinder, and the position of the throttle 14 are controlled by the engine controller 40. The engine controller 40 receives signals from exhaust composition sensors 36 (connection not shown) and 38 as well as from other sensors 50, such as airflow sensors and engine coolant temperature sensors.

Figure 2:
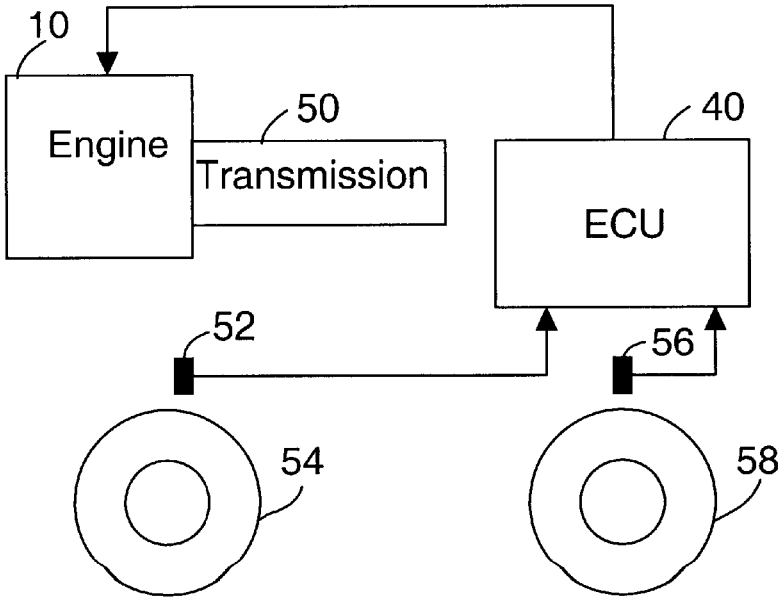
FIG. 2 is a block diagram of a vehicle showing the engine, the transmission, the wheels and salient sensors connected to the engine control unit.

Referring now to FIG. 2, engine 10 is coupled to transmission 50. A gear shift within the transmission is another example of a torque disturbance which must be managed by the engine controller 40 in addition to the torque disturbance described when transitioning between active cylinder subsets in a VDE engine.

Also shown in FIG. 2 are salient pieces of hardware involved in detecting that the vehicle's driving wheels have lost traction. The engine control unit 40 receives signals from a wheel speed sensor 52, which senses wheel speed from the driving wheels 54 and a wheel speed sensor 56, which senses wheel speed from the non-driving wheels 58. If the driving wheels 54 rotate faster than the non-driving wheels 58, wheel slippage is detected. If wheel slippage is sensed, the engine control unit commands a reduction in engine torque to the engine 10. Traction control is another example of a torque disturbance or an abrupt reduction in engine torque requested by the engine control unit 40.

Several examples have been discussed in which a torque disturbance must be managed by the engine controller. The present invention is to provide a relative air-fuel ratio, which is fuel lean to one or more cylinders. Because the amount of air delivered to the cylinders cannot be changed instantly, the method by which relative air-fuel ratio is made leaner is to reduce the amount of fuel delivered to those cylinders. Relative air-fuel ratio is commonly referred to as lambda by those skilled in the art and is defined as the air-fuel ratio divided by the stoichiometric air-fuel ratio. It is also recognized by those skilled in the art that relative air-fuel ratio is measurable and quantifiable within the exhaust products of the engine in spite of the fact that most of the air and fuel no longer exists after combustion has occurred. In an engine system which contains a three-way catalyst, emission control is predicated on maintaining relative air-fuel ratio at unity, or in stoichiometric proportions. Thus, if the fuel to one or more cylinders is less than the stoichiometric proportion, additional fuel must be delivered to one or more cylinders to compensate for the lean cylinder(s). The fuel rich cylinder(s) may develop more torque than would be developed with a stoichiometric proportion of fuel, if the fuel rich cylinders are not very rich. However, the torque reduction in the lean cylinders is greater than any torque increase in the rich cylinders; thus, the overall torque is reduced.

Figure 3:
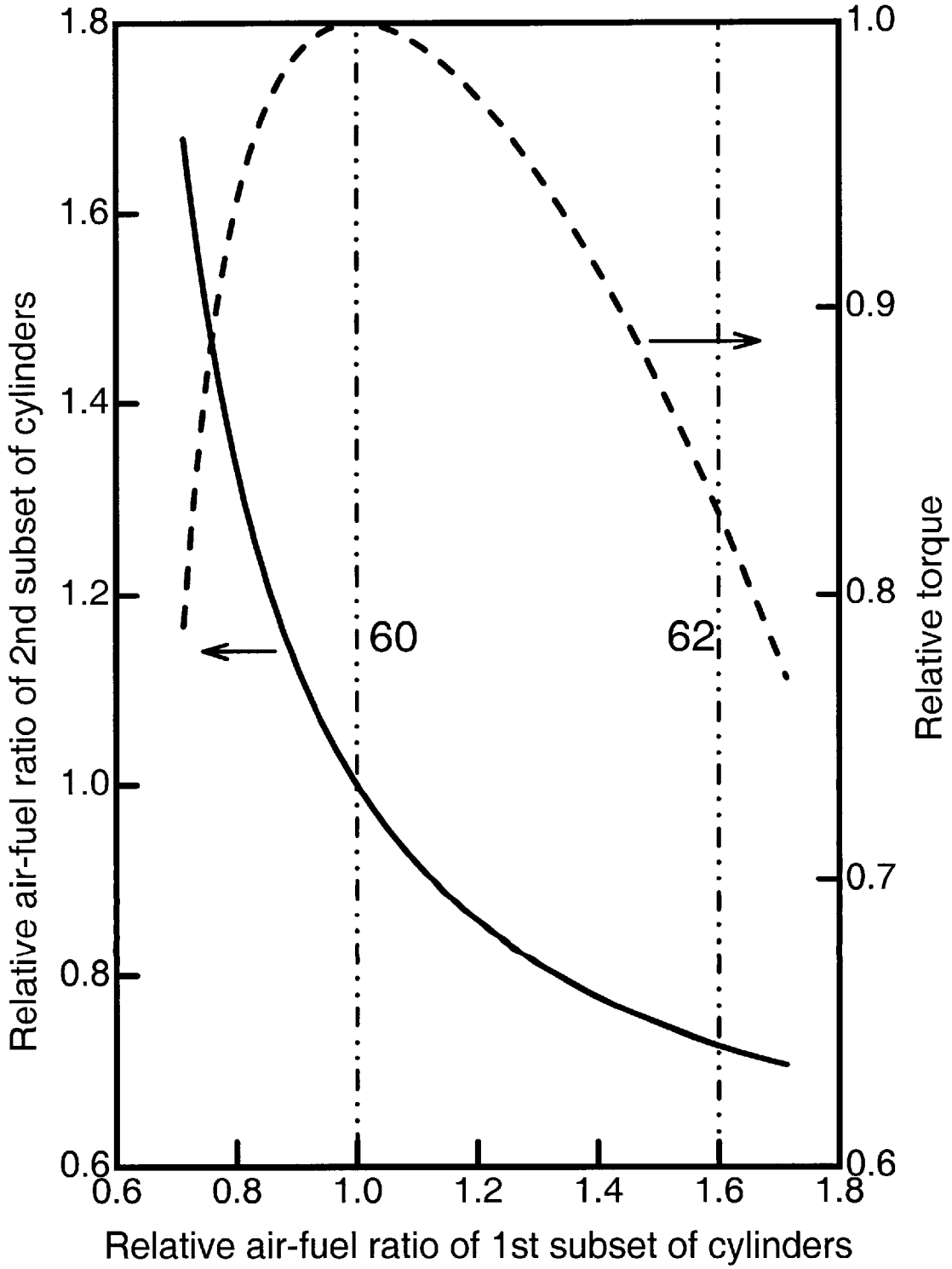
FIG. 3 is a graph showing torque decrease by unequal fueling to engine cylinders.

Shown as a solid line in FIG. 3 is the relative air-fuel ratio of a second subset of cylinders graphed as a function of the relative air-fuel ratio supplied to a first subset of cylinders with the provision that the relative air-fuel ratio of the combination of the first and second subsets of cylinders is one. Inherent in FIG. 3 is that the number of cylinders in the first subset and the second subset of cylinders is equal. This is not a requirement of the method and would not be possible in the case of an engine with three cylinders on a bank as is the case with a V-6 engine. FIG. 3 illustrates the method, but is not intended to be limiting. The dashed line of FIG. 3 shows the relative power produced by the engine as relative air-fuel ratio is changed. Vertical axis 60 crosses through a relative air-fuel ratio of the first subset of cylinders of one which corresponds to the relative air-fuel ratio of the second subset of cylinders at one and the relative torque at one, i.e., the base case. Vertical axis 62 crosses through a relative air-fuel ratio of 1.6, which is in the vicinity of the lean flammability limit for hydrocarbon fuels such as gasoline. The corresponding relative air-fuel ratio for the second subset of cylinders is about 0.75. The relative torque produced is 0.82, nearly a 20% torque reduction compared to the base case.

Figure 4:
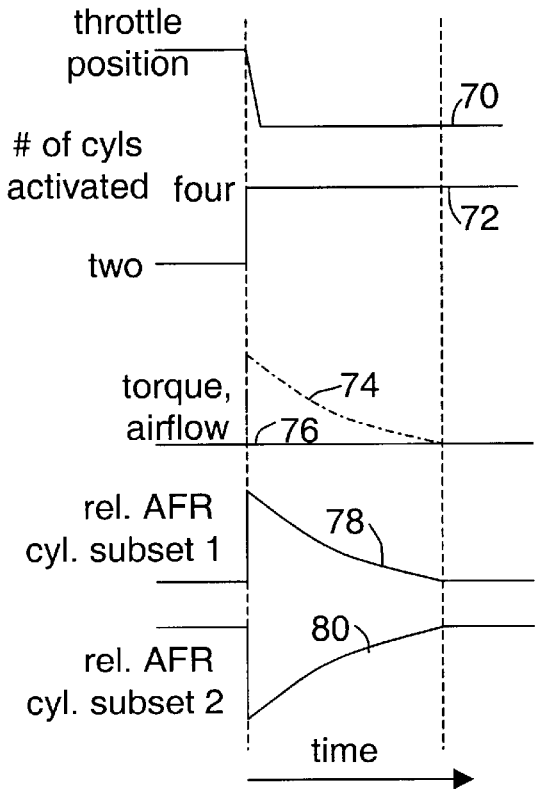
FIG. 4 is a graph showing throttle valve position, air flow into the cylinders, mode of the engine, torque produced by the engine, and relative air-fuel ratio in the first and second subset of cylinders as a function of time during a mode transition in which deactivated cylinders are reactivated.

Referring to FIG. 4, a timeline of a transition in a VDE engine is shown. Initially, the engine is operating with two cylinders activated followed by reactivation of 2 cylinders so that 4 cylinders are operating 72. At the time of reactivation, the throttle is moved to a more closed position 70. The movement of the throttle is very rapid, although not instantaneous, as shown in FIG. 4. The air delivered to the engine lags the throttle movement, shown as dashed curve 74 in FIG. 4. Thus, if no other action were taken, the torque produced by the engine would rise immediately at the time of reactivation of the deactivated cylinders, shown also as dashed curve 74. The torque would then decay to the original level in response to the additional air flow delivered by the throttle. This initial jump in torque is undesirable and would be noticed by an operator of a vehicle. The desired torque response is shown as line 76. To achieve the desired torque response, the relative air-fuel ratio of cylinder subset one, curve 78, is increased at the time of cylinder reactivation and gradually decreased to its initial value. A corresponding change in relative air-fuel ratio of cylinder subset two, curve 80, is made in which it is decreased at the time of cylinder reactivation and gradually increased to its initial value.

Figure 5:
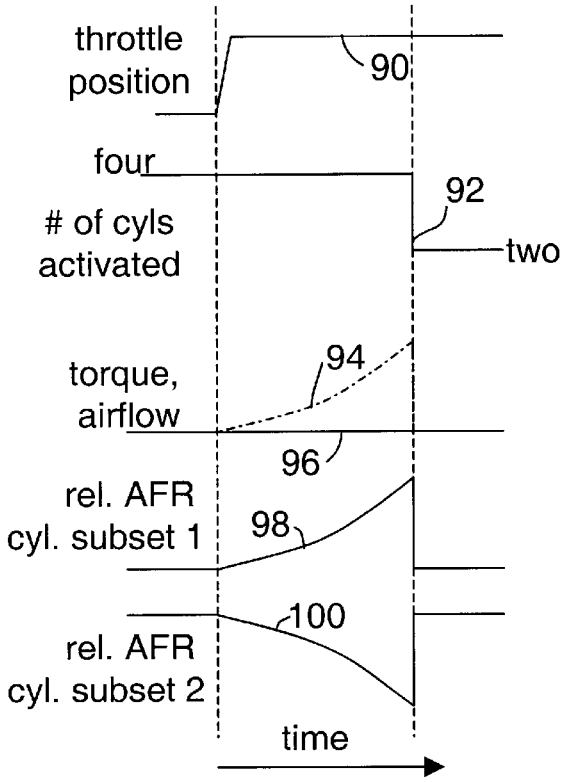
FIG. 5 is a graph showing throttle valve position, air flow into the cylinders, mode of the engine, torque produced by the engine, and relative air-fuel ratio in the first and second subset of cylinders as a function of time during a mode transition in which cylinders are deactivated.

Shown in FIG. 5 is a timeline of a VDE transition in which two cylinders of a four-cylinder engine are deactivated; deactivation is shown as curve 92. To prepare for reactivation of the cylinders, the throttle is moved to a more open position 90. As mentioned above, movement of the throttle is not instantaneous and, furthermore, the air delivered to the engine lags the throttle movement. Air flow to the engine is shown as dashed curve 94 in FIG. 5. If no other action were taken, the torque produced by the engine would rise gradually as the preparation for deactivation is made, shown also as curve 94. At the time of deactivation, the torque would drop suddenly. To achieve the desired torque response, shown as line 96, the relative air-fuel ratio of cylinder subset one, curve 98, is increased gradually in preparation for cylinder deactivation dropped back to its initial value at the time of cylinder deactivation. A corresponding change in relative air-fuel ratio of cylinder subset two, curve 100, is made to achieve the desired torque, line 96, and a desired overall air-fuel ratio of the combination of cylinder subsets.

Although the VDE has been discussed in detail, the invention applies to any transition in an internal combustion engine which leads to a torque discontinuity or disturbance in which overall relative air-fuel ratio is to remain constant through the transition. Several additional examples include a change in compression ratio in a VCR engine, a transmission shift, a traction control event, and a deceleration event.

A torque increase accompanies an increase in compression ratio and vice versa. The case of an increase in compression ratio in a VCR engine is similar to the torque increase during reactivation of cylinders in a VDE. Thus FIGS. 4 and 5 apply to a VCR engine, except that the event that triggers the torque disturbance is the change in compression ratio in the VCR engine in lieu of the reactivation or deactivation of cylinders in the VDE.

Figure 6:
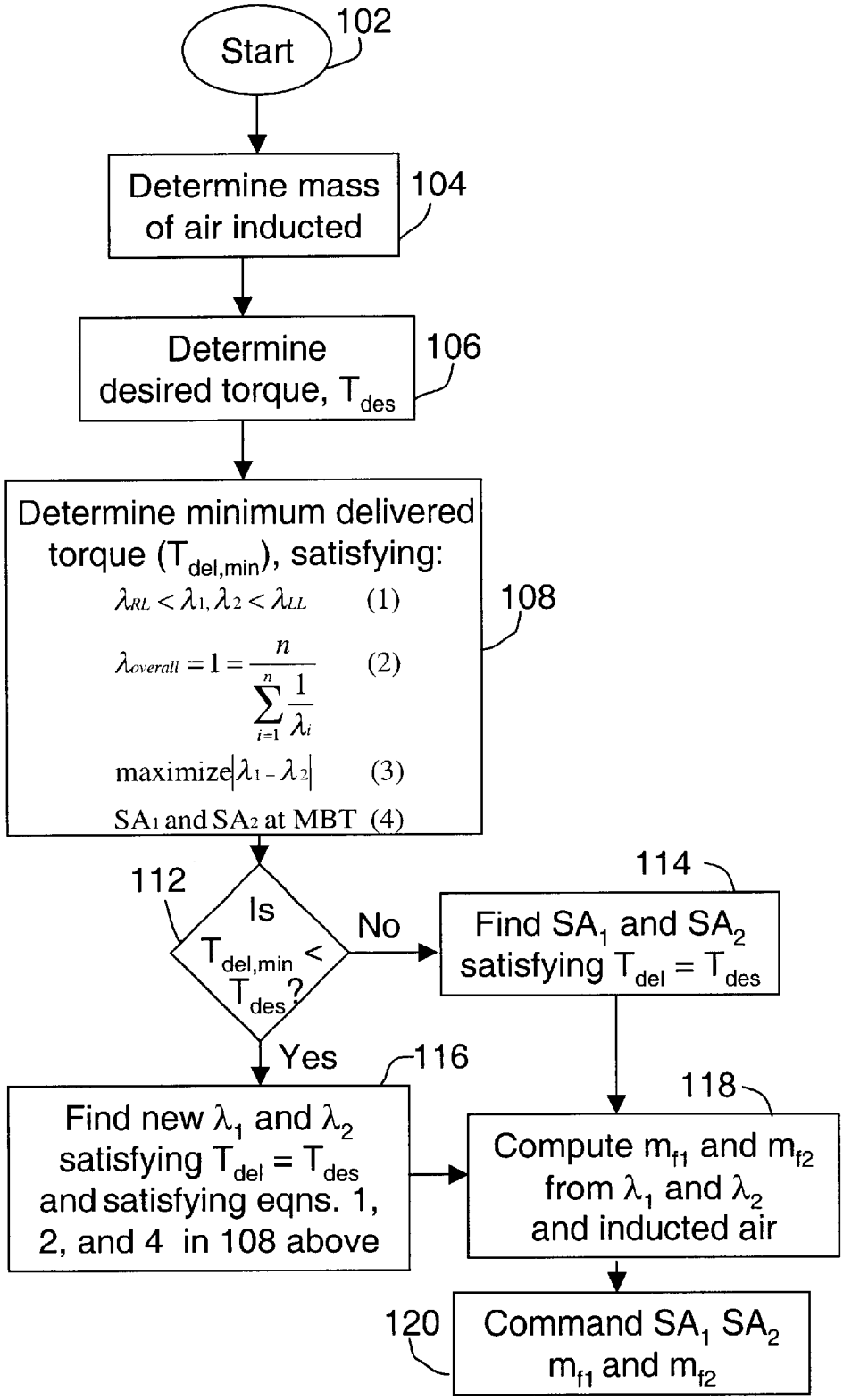
FIG. 6 is a flow diagram describing the sequence of the control logic in which unequal fueling is used to advantage according to an aspect of the present invention.

A flowchart by which the method may be used to advantage is shown in FIG. 6, by way of example. After initiating the computations in step 102, the mass of air being inducted is determined in step 104. This may be based on a mass air sensor signal, throttle position, engine volumetric efficiency tables, and others. The desired torque is determined in step 106. The desired torque may be a reduced torque in the case of a traction control event, a constant torque in the case of a transition among VDE or VCR modes or gear change, or along a torque trajectory when making a transition. The desired torque is based on the transition type and is an input to the flowchart in FIG. 6. In step 108 the amount of torque that would be produced by satisfying equations 1 through 4 is computed. That is, both the relative air-fuel ratio of the first subset of cylinders, $\lambda_1$, and the relative air-fuel ratio of the second subset of cylinders, $\cdot\lambda_2$, must be less than the lean flammability limit, $\cdot\lambda_{LL}$, and greater than the rich flammability limit, $\lambda_{RL}$. Secondly, $\lambda_{overall}$, the overall relative air-fuel ratio must be unity, which is provided when the number of cylinders divided by the sum of the reciprocals of the individual cylinders'relative air-fuel ratio is unity (equation 2 of step 108). Thirdly, the maximum torque reduction by the unequal fueling leads to equation 3 in which the absolute value of the difference in the relative air-fuel ratios between the first and second subsets of cylinders is maximized. Finally, in step 108, the torque is computed with the spark timing in both cylinder subsets, $SA_1$ and $SA_2$, at MBT spark timing, equation 4 of step 108. The minimum delivered torque is less than the desired torque, the unequal delivery of fuel to the first and second subsets of cylinders has been determined to have sufficient range to provide the desired torque; the positive result of the check in block 112 causes control to continue to block 116. Within block 116, new $\lambda_1$ and $\lambda_2$ are computed based on satisfying equations 1, 2, and 4 of block 108. Equation 3 is relaxed to satisfy the requirement that the torque equals the desired torque in block 116. If in block 112 it is determined that the minimum torque to be delivered is greater than the desired torque, the unequal delivery of fuel to the first and second subsets of cylinders lacks sufficient range to provide the desired torque. If block 112 is negative, control passes to block 114 in which spark advance is used to cause delivered torque to desired torque. The values of $\lambda_1$ and $\cdot\lambda_2$ remain as computed in block 108. Both blocks 114 and 116 proceed to block 118, in which the mass of fuel to deliver to the first and second subsets of cylinders is computed. The spark advance and fuel delivery to the first and second cylinder subsets is commanded in block 120. The values of $SA_1$, $SA_2$, $m_{f1}$, and $m_{f2}$, depend on the path through which the control passed, i.e., through block 114 or block 116.

While several examples for carrying out the invention have been described, those familiar with the art to which this invention relates will recognize alternative designs and embodiments for practicing the invention. Thus, the above-described embodiments are intended to be illustrative of the invention, which may be modified within the scope of the following claims.

We claim:

1. A mode transition method for controlling torque produced by an internal combustion engine, the engine having a plurality of cylinders, an exhaust system containing one or more emission aftertreatment devices, and an engine controller operably connected to the engine for controlling the relative air-fuel ratio supplied to the cylinders, the method comprising the steps of:

operating at least one cylinder at a lean relative air-fuel ratio in response to an indication of desired torque; and operating at least one other cylinder at a rich relative air-fuel ratio to reduce emissions which would otherwise be caused by operating said at least one cylinder at said lean relative air-fuel ratio.

2. A mode transition method according to claim 1, comprising the additional step of operating said at least one cylinder at said lean relative air-fuel ratio and operating said at least one other cylinder at said rich relative air-fuel ratio to provide a desired relative air-fuel ratio to the aftertreatment device.

3. A mode transition method according to claim 1, wherein said at least one cylinder at said lean relative air-fuel ratio is richer than a lean flammability limit and said at least one other cylinder at said rich relative air-fuel ratio is leaner than a rich flammability limit.

4. A mode transition method according to claim 1, comprising the additional steps of:

computing said desired torque during said mode transition; and operating said at least one cylinder at said rich relative air-fuel ratio and said at least one other cylinder at said lean relative air-fuel ratio to provide said desired torque during said mode transition.

5. A mode transition method according to claim 1, comprising the additional steps of:

computing said desired torque during said mode transition; and operating said at least one cylinder at said rich relative air-fuel ratio, operating said at least one other cylinder at said lean relative air-fuel ratio, and providing a spark timing which is retarded from a predetermined spark timing to provide said desired torque during said mode transition.

6. A mode transition method according to claim 5, wherein said predetermined spark timing is a spark timing which provides the maximum torque.

7. A mode transition method according to claim 2, wherein said desired relative air-fuel ratio is substantially a stoichiometric relative air-fuel ratio.

8. A mode transition method according to claim 1, wherein the mode transition comprises a reactivation of a portion of the cylinders, wherein the engine is a variable displacement engine.

9. A mode transition method according to claim 1, wherein the mode transition comprises a deactivation of a portion of the cylinders, wherein the engine is a variable displacement engine.

10. A mode transition method according to claim 1, wherein the mode transition comprises a change in compression ratio, wherein the engine comprises means to vary compression ratio.

11. A mode transition method according to claim 1, wherein the mode transition comprises a transition among gears in a transmission coupled to the engine.

12. A mode transition method according to claim 1, wherein the mode transition comprises a traction control event.

13. A mode transition method for controlling torque produced by an internal combustion engine, the engine having a plurality of cylinders, an exhaust system containing one or more emission aftertreatment devices, and an engine controller operably connected to the engine for controlling the relative air-fuel ratio supplied to the cylinders, the method comprising the steps of:

operating at least one cylinder at a lean relative air-fuel ratio to reduce torque; and operating at least one other cylinder at a rich relative air-fuel ratio to provide a desired relative air-fuel ratio to the aftertreatment device.

14. A mode transition method according to claim 13, wherein said at least one cylinder at said lean relative air-fuel ratio is richer than a lean flammability limit and said at least one other cylinder at said rich relative air-fuel ratio is leaner than a rich flammability limit.

15. A mode transition method according to claim 13, comprising the additional steps of:

computing a desired torque during said mode transition; and operating said at least one cylinder at said rich relative air-fuel ratio and said at least one other cylinder at said lean relative air-fuel ratio to provide said desired torque during said mode transition.

16. A mode transition method according to claim 13, comprising the additional steps of:

computing a desired torque during said mode transition; and operating said at least one cylinder at said rich relative air-fuel ratio, operating said at least one other cylinder at said lean relative air-fuel ratio, and providing a spark timing which is retarded from a predetermined spark timing to provide said desired torque during said mode transition.

17. A system for controlling torque during a transition of operating mode in an internal combustion engine, the engine having a plurality of cylinders, a throttle valve disposed in an air intake duct, an engine exhaust system containing one or more emission aftertreatment devices, and an engine controller operably connected to the engine for controlling the relative air-fuel ratio to change torque toward a desired torque supplied by the cylinders, wherein said engine controller provides to at least one cylinder a lean relative air-fuel ratio and to at least one other cylinder a rich relative air-fuel ratio to reduce emissions which would otherwise be caused by operating said at least one cylinder at a lean relative air-fuel ratio.

18. A system according to claim 17, wherein said engine controller computes a desired throttle valve position based on said desired torque during the transition in operating mode and commands the throttle valve to assume said desired throttle valve position.

19. A system according to claim 17, wherein said engine controller computes said desired torque during said mode transition; and operates said at least one cylinder at said rich relative air-fuel ratio and said at least one other cylinder at said lean relative air-fuel ratio to provide said desired torque during said mode transition.

20. A system according to claim 17, wherein said engine controller computes a desired torque during said mode transition; and operates said at least one cylinder at said rich relative air-fuel ratio, operates said at least one other cylinder at said lean relative air-fuel ratio, and provides a spark timing which is retarded from a predetermined spark timing to provide said desired torque during said mode transition.

* * * * *